US007757131B2

(12) United States Patent
Mochizuki

(10) Patent No.: US 7,757,131 B2
(45) Date of Patent: Jul. 13, 2010

(54) IMAGE FORMING APPARATUS

(75) Inventor: Chigusa Mochizuki, Osaka (JP)

(73) Assignee: Kyocera Mita Corporation (JP)

( * ) Notice: Subject to any disclaimer, the term of this patent is extended or adjusted under 35 U.S.C. 154(b) by 554 days.

(21) Appl. No.: 11/711,334

(22) Filed: Feb. 27, 2007

(65) Prior Publication Data

US 2007/0220359 A1 Sep. 20, 2007

(30) Foreign Application Priority Data

Feb. 28, 2006 (JP) ..... 2006-052403
Feb. 28, 2006 (JP) ..... 2006-052666

(51) Int. Cl.
*G07F 11/00* (2006.01)

(52) U.S. Cl. ..... 714/57; 358/1.14; 399/18

(58) Field of Classification Search ..... None
See application file for complete search history.

(56) References Cited

U.S. PATENT DOCUMENTS 6,681,349 B2 * 1/2004 Sekizawa ..... 714/47
6,809,831 B1 * 10/2004 Minari ..... 358/1.15
6,885,469 B1 * 4/2005 Tanimoto ..... 358/1.14
7,209,247 B1 * 4/2007 Iwadate ..... 358/1.14
7,227,651 B2 * 6/2007 Kamiya, Yuka ..... 358/1.14
2007/0109586 A1 * 5/2007 Yamada et al. ..... 358/1.14
2007/0229877 A1 * 10/2007 Shima ..... 358/1.14
2007/0268510 A1 * 11/2007 Wushour et al. ..... 358/1.14
2007/0285702 A1 * 12/2007 Akiyoshi ..... 358/1.14
2008/0068640 A1 * 3/2008 Todaka ..... 358/1.14

FOREIGN PATENT DOCUMENTS

JP 9-230755 9/1997
JP 2002-229393 8/2002
JP 2005-208335 8/2005
JP 2006-23669 1/2006

* cited by examiner

*Primary Examiner*—Christopher S McCarthy
(74) *Attorney, Agent, or Firm*—Gerald E. Hespos; Michael J. Porco

(57) ABSTRACT

An image forming apparatus capable of executing a plurality of functions is provided with operating portion to which an operation instruction is inputted by an operator; display portion for displaying an operation guide to the operator; error detecting portion for detecting an occurrence of an operation error; and display controller for causing a screen displayed on the display portion to differ depending on whether or not the error detecting portion is detecting any operation error if an operation instruction is inputted to the operation portion by the operator.

7 Claims, 12 Drawing Sheets

IMAGE FORMING APPARATUS

BACKGROUND OF THE INVENTION

1. Field of the Invention

The present invention relates to an image forming apparatus such as a copier, a facsimile machine or a composite apparatus.

2. Description of the Related Art

In an image forming apparatus such as a copier, a facsimile machine or a composite apparatus, it has been conventionally known, in the case of an error such as a sheet jam, to display an occurrence of such an error on a display device arranged in an operation panel (see, for example, Japanese Unexamined Patent Publication No. 2005-208335). Further, in a known composite apparatus provided with a copier function, a facsimile function, a printer function and other functions, even if an error has occurred during a certain operation, there are cases where other operations can be executed. Thus, even if the operation error is not removed, the other operations not affected by the error are made executable. There have been also proposed image forming apparatuses that display other executable operations and operation statuses such as a job reception status on a display device.

In the above image forming apparatus according to prior art, an operator can confirm the other executable operations and already received jobs by displaying the above operation statuses on the display device in accordance with an instruction from the operator even during an operation error. However, in this case, the display of the operation error made on the operation panel is promptly switched to another display upon an instruction from the operator regardless of whether or not there is any occurrence of the operation error. Therefore, the operator may not be able to sufficiently recognize in which operation being executed in the image forming apparatus the error has occurred.

SUMMARY OF THE INVENTION

In order to solve the aforementioned problem, an object of the present invention is to enable an operator to sufficiently recognize an occurrence of an operation error even if an operation instruction is inputted by the operator during the occurrence of the operation error.

Specifically, the present invention is directed to an image forming apparatus capable of executing a plurality of functions, comprising operating portion to which an operation instruction is inputted by an operator; display portion for displaying an operation guide to the operator; error detecting portion for detecting an occurrence of an operation error; and display controller for causing a screen displayed on the display portion to differ depending on whether or not the error detecting portion is detecting any operation error if an operation instruction is inputted to the operation portion by the operator.

With this construction, since the screen displayed on the display portion is caused to differ by the display controller depending on whether or not the error detecting portion is detecting any operation error if the operation instruction is inputted to the operation portion by the operator. Thus, the operator can recognize anew whether or not an error is occurring in any one of operations in the image forming apparatus by seeing which screen is displayed. Therefore, the operator can sufficiently recognize the occurrence of the operation error in the image forming apparatus.

These and other objects, features, aspects and advantages of the present invention will become more apparent upon a reading of the following detailed description and accompanying drawings.

DESCRIPTION OF THE PREFERRED EMBODIMENTS

Hereinafter, one embodiment of a composite apparatus as one example of an image forming apparatus according to the present invention is described with reference to the accompanying drawings.

Figure 1:
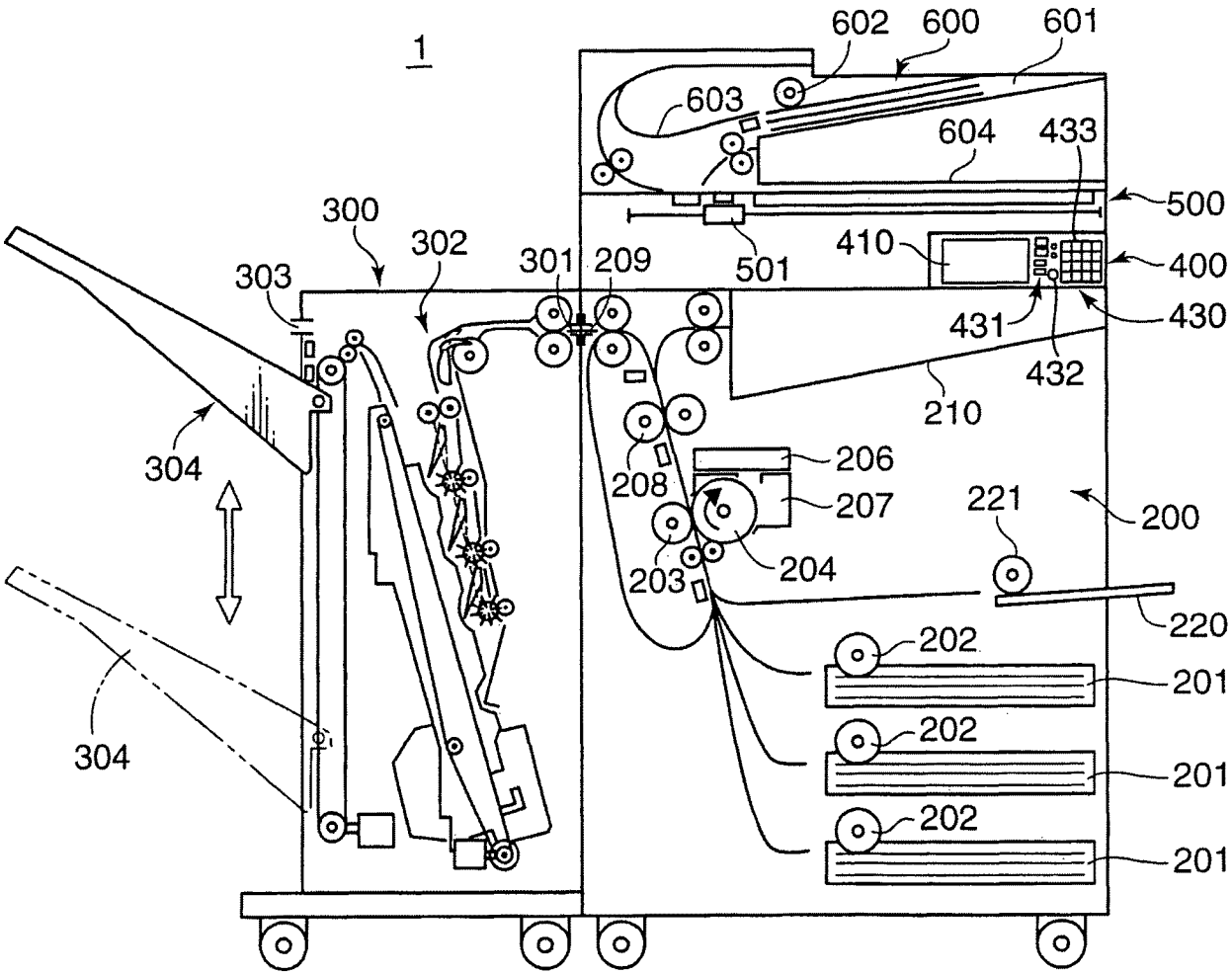
FIG. 1 is a schematic side view in section mainly showing the construction of a composite apparatus according to one embodiment of the invention.

FIG. 1 is a schematic side view in section mainly showing the construction of a composite apparatus according to one embodiment of the present invention. A composite apparatus 1 is comprised of a main unit 200, a sheet post-processing unit 300 arranged at a sheet discharge side, e.g. at the left side of the main unit 200, an operation unit 400 used by a user to input various operation commands and the like, a document reading unit 500 arranged atop the main unit 200, and a document feeding unit 600 arranged atop the document reading unit 500.

The operation unit 400 is provided with a display device 410 including an LCD (liquid crystal display) or the like, and an operation key assembly 430 used by an operator to input operation instructions. The operation key assembly 430 includes function changeover keys 431, a start key 432, a numeric pad 433 and the like. The operator uses a desired function changeover key 431 to change the function among a scanner function, a facsimile function, a printer function, a copier function and a function of displaying data stored in a HDD 74 to be described later or an external memory on a screen and, for example, printing, facsimile transmitting or deleting the data selected on this screen (hereinafter, called "box function").

The document feeding unit 600 is provided with a document placing portion 601, a feed roller 602, a document conveying portion 603 and a document discharging portion 604, whereas the document reading unit 500 is provided with a scanner 501. The feed roller 602 dispenses a specified number of documents set on the document placing portion 601 one by one, and the document conveying portion 603 successively conveys the dispensed documents to a reading position of the scanner 501. The scanner 501 successively reads images of the documents being conveyed, and the documents having the images thereof read are discharged to the document discharging portion 604.

The main unit 200 is provided with a plurality of sheet cassettes 201, a plurality of feed rollers 202, a transfer roller 203, a photoconductive drum 204, an exposing device 206, a developing device 207, a fixing roller 208, a discharge opening 209, a discharge tray 210 and the like.

The photoconductive drum 204 is uniformly charged by a charging device (not shown) while being rotated in a direction of arrow. The exposing device 206 irradiates the photoconductive drum 204 with a laser beam modulated in accordance with a document image data read by the document reading unit 500 to form an electrostatic latent image of each on the outer circumferential surface of the drum 204. The developing device 207 supplies developing agent to the photoconductive drum 204 to form a toner image.

On the other hand, each feed roller 202 dispenses a print sheet from the corresponding sheet cassette 201 accommodating print sheets and feeds it to the transfer roller 203. The transfer roller 203 causes the toner image on the photoconductive drum 204 to be transferred to the print sheet conveyed thereto, and the fixing roller 208 heats the transferred toner image to fix it to the print sheet. Thereafter, the print sheet is brought into the sheet post-processing unit 300 through the discharge opening 209 of the main unit 200. Print sheets are also discharged onto the discharge tray 210 according to needs.

The sheet post-processing unit 300 is provided with a load opening 301, a print-sheet conveying portion 302, an unload opening 303, a stack tray 304 and the like. The print-sheet conveying portion 302 successively conveys the print sheets brought into the load opening 301 through the discharge opening 209 and finally discharges the print sheets to the stack tray 304 through the unload opening 303. The stack tray 304 is so constructed as to be vertically movable in directions of arrows according to the number of stacked print sheets discharged through the unload opening 303.

Figure 2:
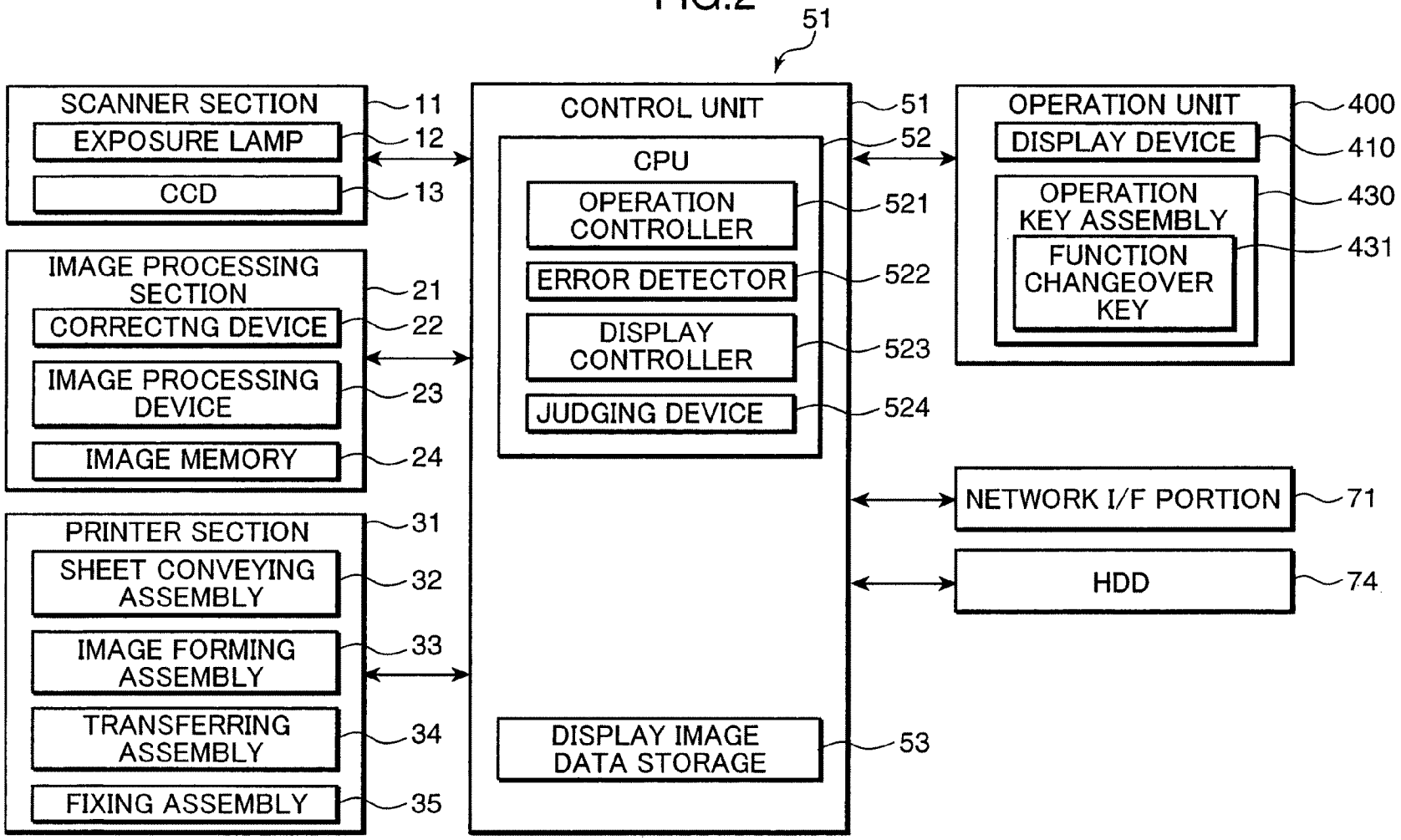
FIG. 2 is a control block diagram of the composite apparatus shown in FIG. 1.

FIG. 2 is a control block diagram of the composite apparatus shown in FIG. 1. The composite apparatus 1 is provided with a scanner section 11, an image processing section 21, a printer section 31, the operation unit 400, a control unit 51, a network I/F (interface) portion 71, and the HDD (hard disk drive) 74.

The scanner section 11 includes an exposure lamp 12 and CCDs (charge-coupled devices) 13 constituting the scanner 501 shown in FIG. 1. The scanner section 11 is such that a document is irradiated by the exposure lamp 12, a light reflected by the document is received by the CCDs 13 to thereby read an image from the document, and an image data corresponding to the read image is outputted to the image processing section 21.

The image processing section 21 includes a correcting device 22, an image processing device 23 and an image memory 24. The image processing section 21 processes the read image data by means of the correcting device 22 and the image processing device 23 according to needs and saves the processed image data in the image memory 24 or outputs it to the printer section 31. The correcting device 22 applies specified corrections such as a level correction and a y-correction to the read image data. The image processing device 23 applies various processings such as compression or expansion and enlargement or size-reduction to the image data.

The printer section 31 includes a sheet conveying assembly 32 constructed by the sheet cassettes 201, the feed rollers 202 and the like shown in FIG. 1; an image forming assembly 33 constructed by the photoconductive drum 204, the exposing device 206, the developing device 207 and the like shown in FIG. 1; a transferring assembly 34 constructed by the transfer roller 203 and the like shown in FIG. 1; and a fixing assembly 35 constructed by the fixing roller 208 and the like shown in FIG. 1. The printer section 31 prints an image on a recording sheet using an image data read by the scanner section 11. Specifically, the sheet conveying assembly 32 conveys a recording sheet to the image forming assembly 33, the image forming assembly 33 forms a toner image corresponding to the above image data, the transferring assembly 34 transfers the toner image to the recording sheet, and the fixing assembly 35 fixes the toner image to the recording sheet to print the image.

The network I/F portion 71 controls various data transmission and reception to and from external apparatuses via a LAN using a network interface (10/100 Base-TX). The HDD 74 saves the image data read by the scanner section 11 and an output format set in the image data.

The operation unit 400 is provided with the display device 410, the operation key assembly 430 and the like shown in FIG. 1. The display device 410 is constructed by a touch panel unit obtained by combining a touch panel and an LCD or the like. The display device 410 displays various operation screens and enables the operator to input commands to execute various functions by the touch of a display surface (displayed operation keys) by the operator. The operation key assembly 430 includes the function changeover keys 431, the start key 432, the numeric pad 433 and the like as described above, wherein a group of keys of the operation key assembly 430 are not keys employing touch sensors, but mechanically constructed keys.

The control unit 51 includes a CPU 52 and a display image data storage 53. The CPU 52 governs the operation control of the composite apparatus 1. The display image data storage 53 stores various still image data and moving image data to be displayed on the display device 410.

The CPU 52 includes an operation controller 521, an error detector 522, a display controller 523 and a judging device 524.

The operation controller 521 governs the operation control of the respective sections (scanner section 11, image processing section 21, printer section 31, etc.) of the composite apparatus 1. The error detector 522 detects operation errors of the respective sections during the operation of the composite apparatus 1. Operation errors include, for example, sheet jams in a sheet conveyance path from the sheet cassettes 201 to the discharge tray 210, the document conveying portion 603 of the document feeding unit 600 and the like, and abnormal stops caused by the breakdown of the image forming assembly 33, the transferring assembly 34, and the like.

The display controller 523 is for controlling the operation of the display device 410. The display controller 523 causes operation guiding screens to be displayed to the operator. For example, the display controller 523 reads necessary moving image data from the display image data storage 53 and reproduces them or reads necessary still image data from the display image data storage 53. Thus the display controller 523 causes the display device 410 to display screens showing an operation procedure of removing the operation error in an animated manner, guide screens for receiving the input of instructions concerning the respective functions such as the copier function, and other screens if the operation error has been detected by the error detector 522. In this embodiment, an error display by the display device 410 may be made by means of either screens showing moving images guiding the operation error removing procedure or screens showing still images indicating the operation error.

The judging device 524 judges, in the case where a function switch instruction is inputted to any function changeover key 431 by an operator, whether or not the operation based on the function indicated by the function switch instruction is executable even if the operation error detected by the error detector 522 continuous. For example, the judging device 524 includes a data table relating various operation errors to other operations executable even during the respective operation errors. When an operation error is detected by the error detector 522, the judging device 524 reads the other executable operations from the data table and notifies them to the display controller 523 and the operation controller 521.

Figure 3:
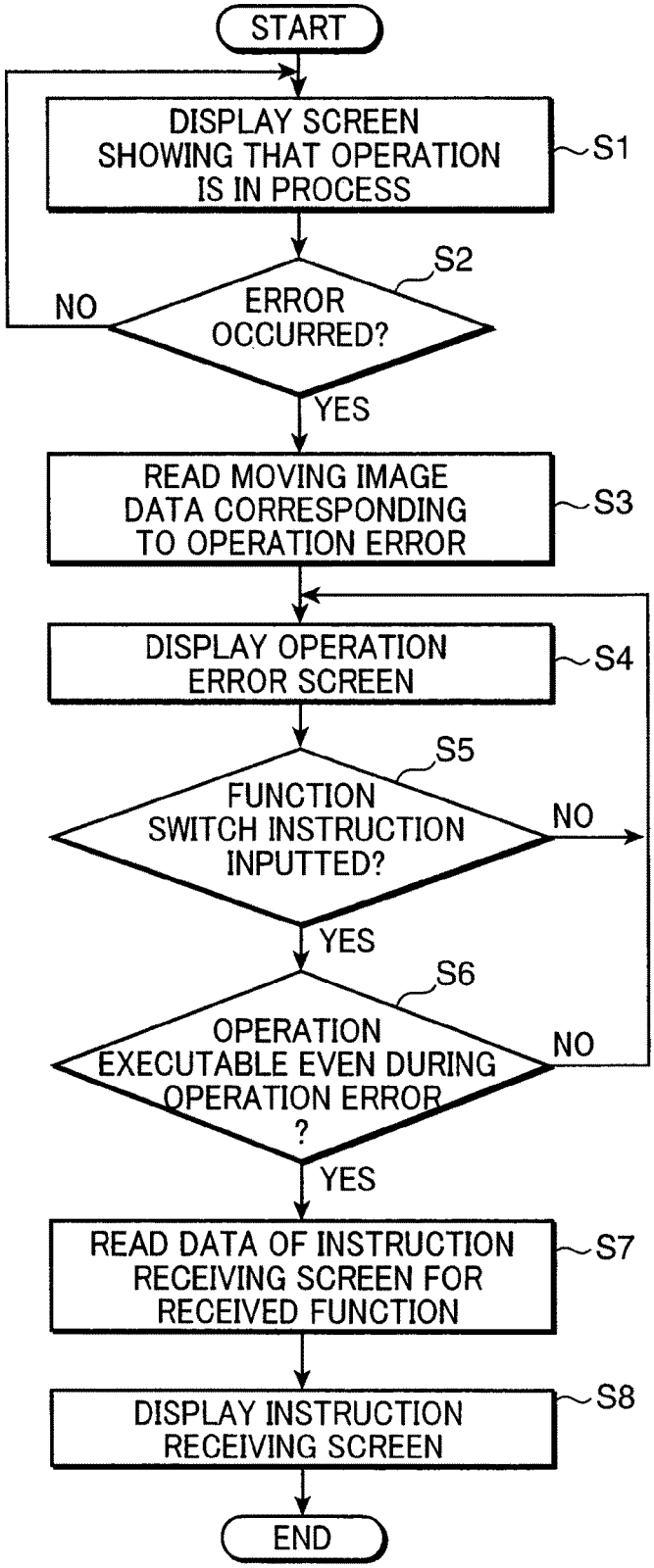
FIG. 3 is a flow chart showing a first embodiment of a screen display control executed when an operation error occurs and an operation instruction is received in the composite apparatus.
Figure 4:
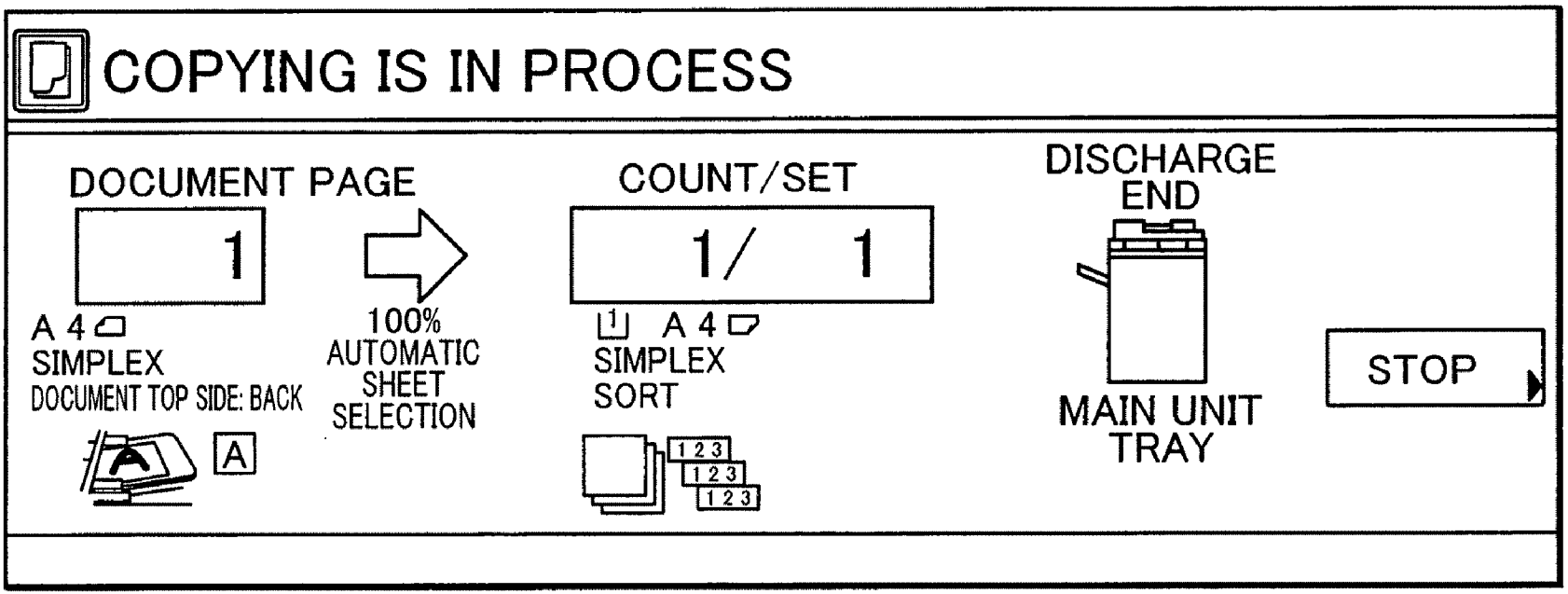
FIG. 4 is a diagram showing an example of a display screen displaying that copying is in process.
Figure 5:
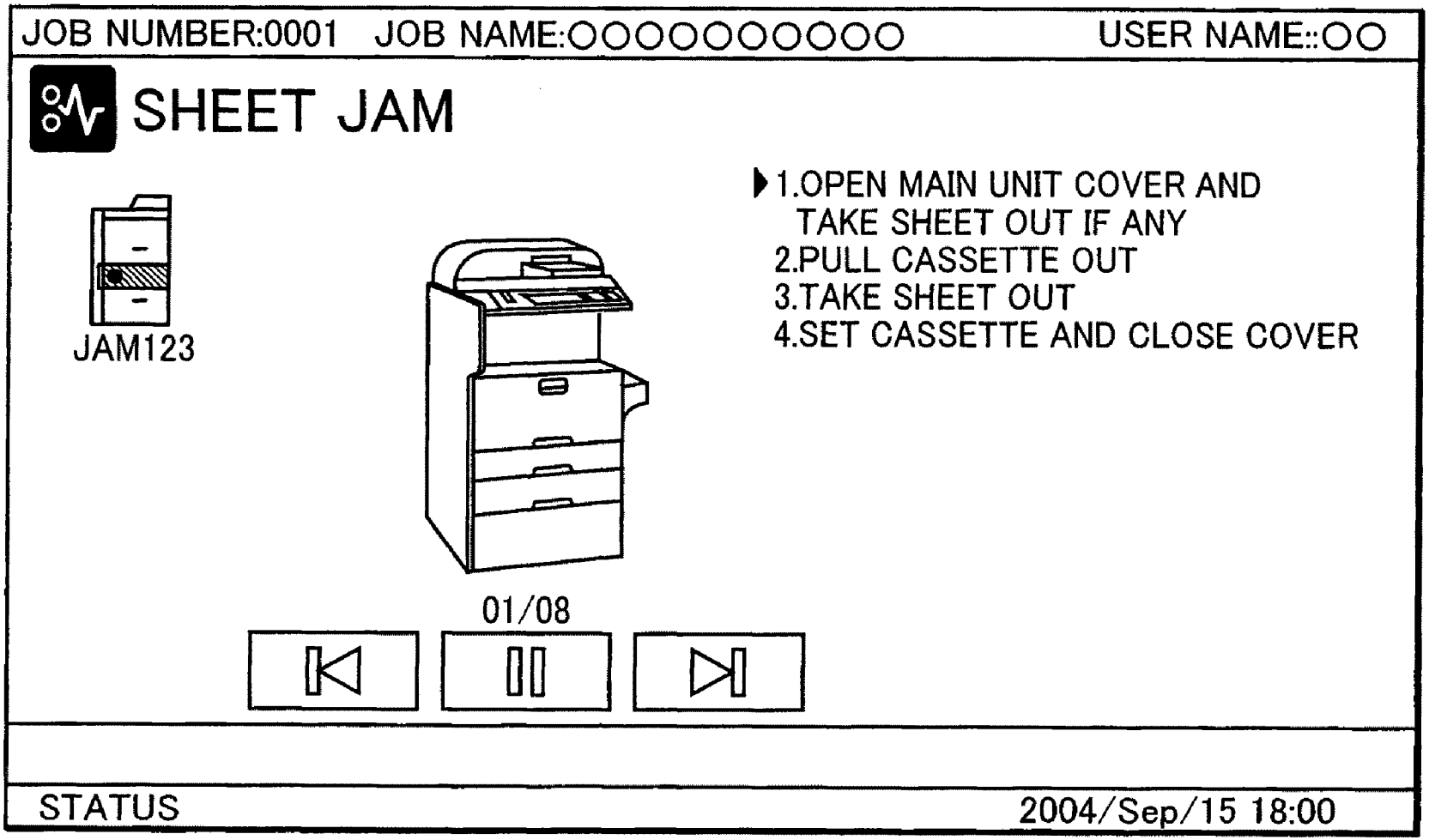
FIG. 5 is a diagram showing an example of a display screen displaying that an operation error of a sheet jam occurs.
Figure 6:
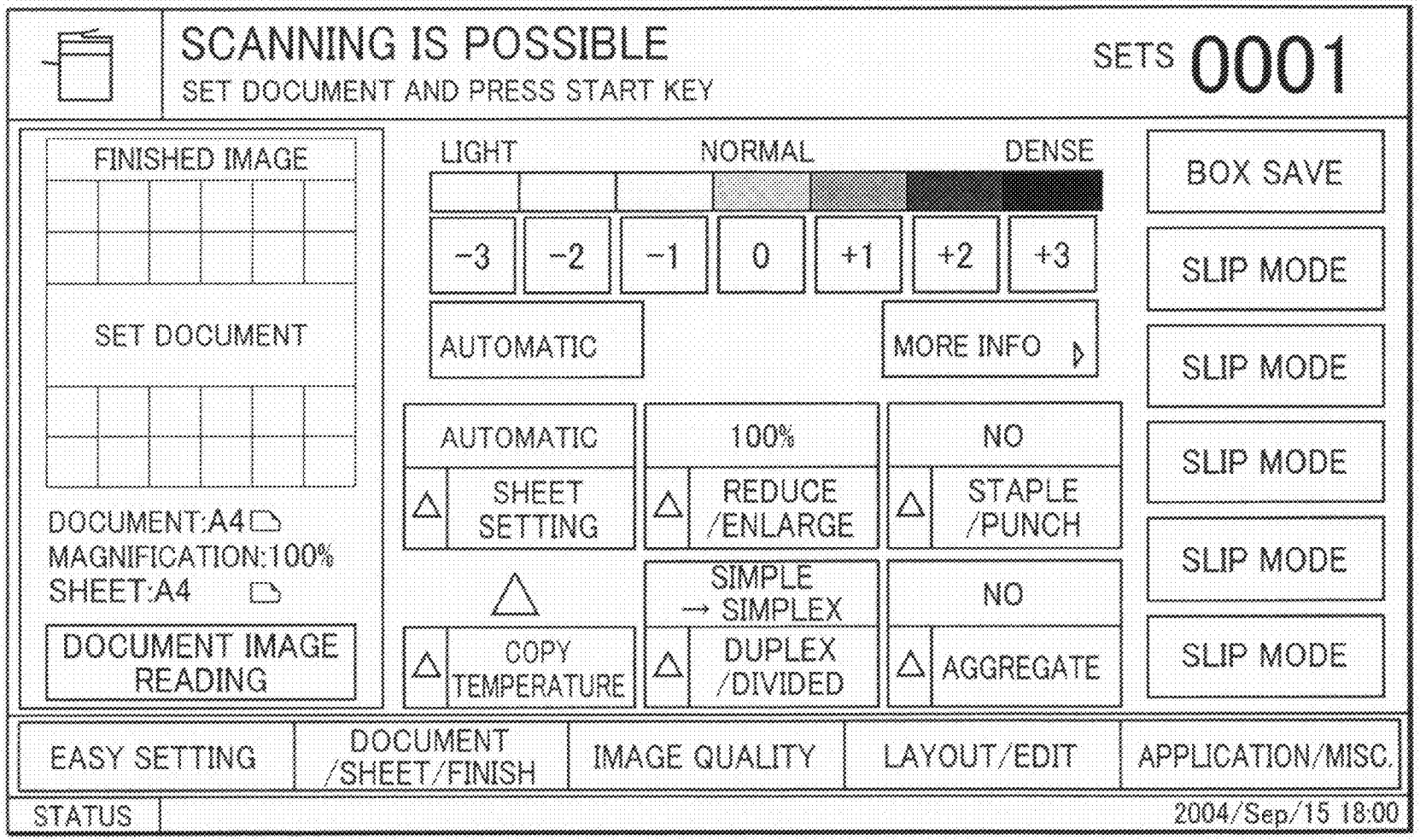
FIG. 6 is a diagram showing an example of a reception screen for an operation instruction concerning a scanner function.
Figure 7:
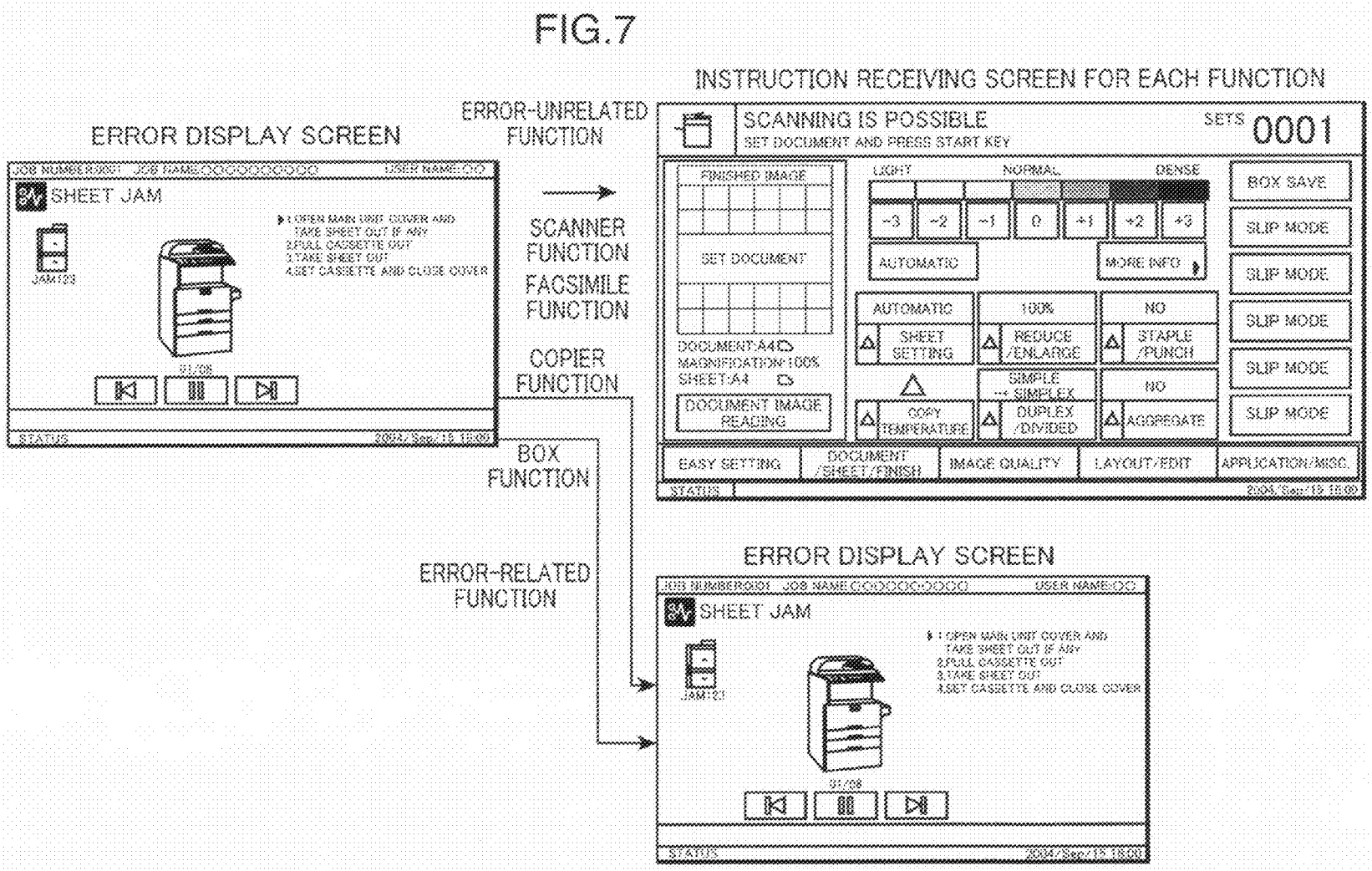
FIG. 7 is a transition diagram of display screens of a display device.

Next, a first embodiment of a screen display control executed when an operation error occurs and an operation instruction is received in the composite apparatus 1 is described. FIG. 3 is a flow chart showing the first embodiment of the screen display control executed when an operation error occurs and an operation instruction is received in the composite apparatus 1; FIG. 4 is a diagram showing an example of a display screen showing that copying is in process; FIG. 5 is a diagram showing an example of a display screen in the event of an operation error caused by a sheet jam; FIG. 6 is a diagram showing an example of a reception screen for an operation instruction concerning the scanner function; and FIG. 7 is a transition diagram of display screens of the display device 410.

In the composite apparatus 1, if the operation controller 521 is causing the respective sections to perform operations in accordance with an operation instruction or the like from the operator inputted in the operation unit 400, e.g. if the operation controller 521 is causing the scanner section 11, the image processing section 21 and the printer section 31 to perform a copying operation, the display controller 523 causes the display device 410 to display a display screen showing that copying is in process as shown in FIG. 4 (Step S1). Hereinafter, description is given, taking the case of the copying operation as an example.

If the error detector 522 detects an operation error caused, for example, by a sheet jam during the copying operation (YES in Step S2), the display controller 523 reads moving image data for screen displays in the event of the operation error caused by the sheet jam from the display image data storage 53 (Step S3), reproduces the moving image data and causes them to be displayed on the display device 410 (Step S4). The display controller 523 causes the display device 410 to display, for example, a screen as shown in FIG. 5 by this moving image data reproduction and also to display an operation procedure necessary to remove the operation error caused by the sheet jam.

If a function switch instruction from an operator is inputted to any function changeover key 431 (YES in Step S5), the judging device 524 judges whether or not an operation based on the function after the switch in response to this instruction is executable even if the presently occurring operation error (operation error detected by the error detector 522 in Step S2) continues without being removed (Step S6).

If the judging device 524 judges that the function indicated by the function switch instruction inputted to the function changeover key 431 is executable even if this operation error is not removed (YES in Step S6), the display controller 523 reads image data necessary to display an instruction receiving screen for the function indicated by the function switch instruction from the display image data storage 53 (Step S7), and causes the display device 410 to display the read image data (Step S8).

For example, even if a sheet jam occurs in the sheet conveyance path from the sheet cassettes 201 during the copying operation, the copying operation is stopped, and the display of an occurrence of the sheet jam is made on the display device 410, a scanning operation can be performed since a read document is conveyed by the document conveying portion 603 of the document feeding unit 600 and the sheet conveyance path extending from the sheet cassettes 201 needs not be used even after the reading operation. Thus, if an instruction to switch the function to the scanner function is inputted the corresponding function changeover key 431 from the operator, the display controller 523 reads necessary image data from the display image data storage 53 and causes the display devices 410 to display the instruction receiving screen for the scanner function as shown in FIG. 6.

On the other hand, if the judging device 524 judges that the function indicated by the function switch instruction inputted to the function changeover key 431 from the operator is inexecutable unless the presently occurring operation error is removed, while the operation error removing procedure is displayed on the display device 410 (NO in Step S6), this routine returns to Step S4 and the display controller 523 continues to cause the display device 410 to display the operation procedure necessary to remove the above operation error. For example, if the function is switched to the box function when a sheet jam occurs in the sheet conveyance path extending from the sheet cassettes 201 during a copying operation, the copying operation is stopped and the display of an occurrence of the sheet jam is made on the display device 410, and an instruction to print a selected data is given using this box function, this operation is judged to be inexecutable by the judging device 524 unless the sheet jam error is removed since the sheet conveyance path extending from the sheet cassette 201 is used for this operation, and the display controller 523 continues to cause the display device 410 to display the operation procedure necessary to remove the sheet jam.

As described above, according to the above display control by the display controller 523, In the case the screen showing the error removing procedure is displayed on the display device 410 as shown in FIG. 7, if the operation based on the next function for which the operator gave the switch instruction is executable regardless of this error, the display controller 523 immediately switches the screen showing the error removing procedure to an instruction receiving screen for the next function. If the operation based on the next function for which the operator gave the switch instruction is inexecutable because of this error, the display controller 523 keeps the screen showing the error removing procedure displayed.

Thus, if the operator presses any function changeover key 431 down, an instruction receiving screen for a function corresponding to the pressed-down function changeover key 431 is displayed on the display device 410 in the case where this function is executable even during an occurrence of an error, whereas a screen showing an error removing procedure is displayed if this function is inexecutable. Thus, this composite apparatus 1 not only performs an operation based on the function executable in the event of an error, but also enables the operator to recognize whether or not the operation based on the function corresponding to the pressed-down function changeover key 431 is executable during the occurrence of the error by looking at the display screen on the display device 410. Further, the operator can input an instruction for the next function immediately after the display screen on the display device 410 is switched to the instruction receiving screen for this next function.

Figure 8:
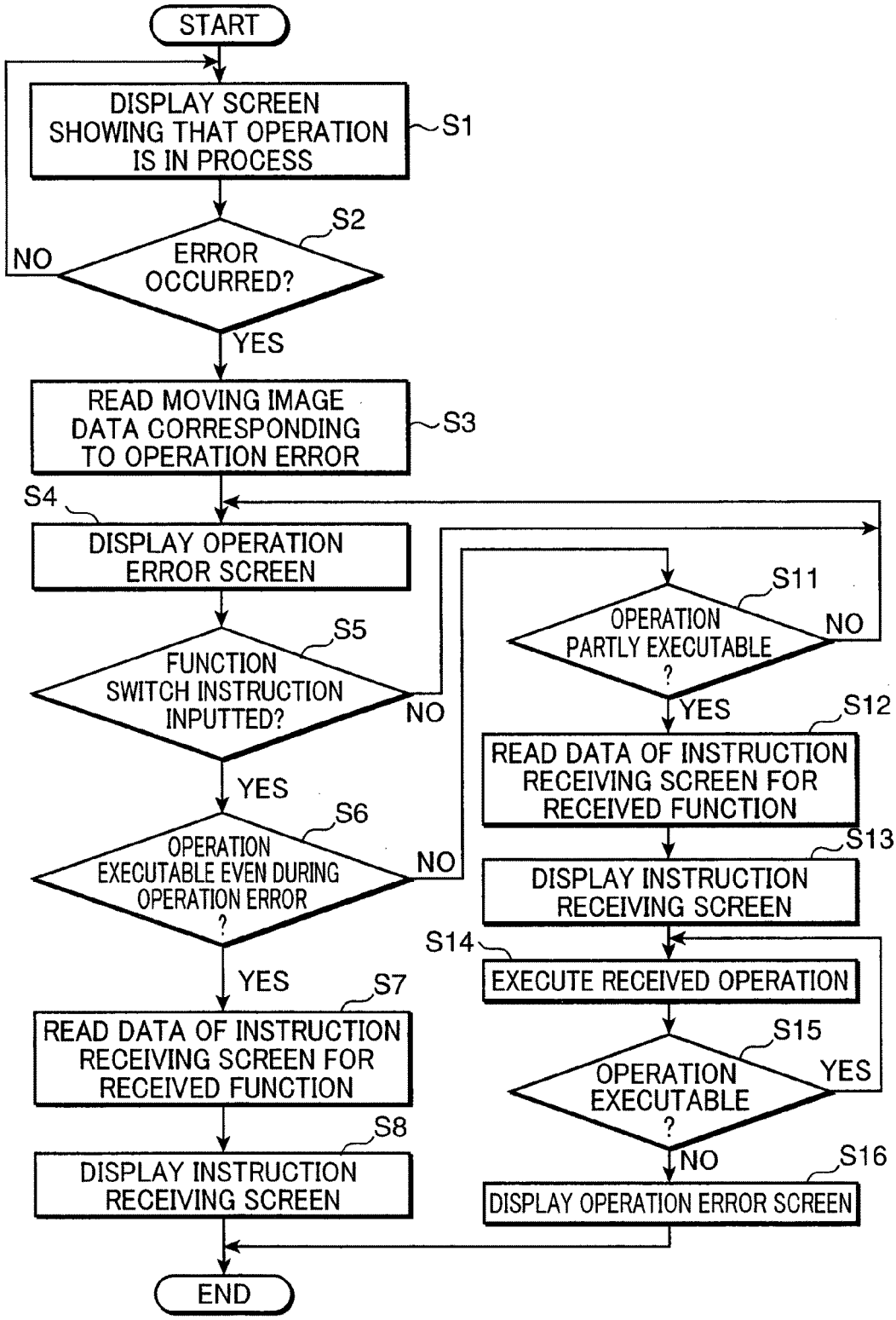
FIG. 8 is a flow chart showing a second embodiment of the screen display control executed when an operation error occurs and an operation instruction is received in the composite apparatus.

The present invention is not limited to the construction of the foregoing embodiment and various modifications can be made. For example, in the first embodiment, the display controller 523 lets the screen showing the error removing procedure displayed as it is and does not switch the screen to the instruction receiving screen for the next function if the operation based on the next function for which a switch instruction is given by the operator cannot be executed because of this error. However, as in a second embodiment shown in FIG. 8, if the judging device 524 judges that an operation based on a next function for which a switch instruction is given by the operator is only partly executable (YES in Step S11) even though this operation is not completely executable because of this error (NO in Step S6), the display controller 523 may switch the screen to an instruction receiving screen for the next function (Steps S12, S13). It should be noted that processes similar to those shown in FIG. 3 are identified by the same reference numerals and not described.

In the case of executing this control, if an operation instruction is inputted to the operation key assembly 430 from the operator after the display controller 523 switches the screen to the instruction receiving screen for the next function, the operation controller 521 causes a series of operations based on this instruction to start and operations executable regardless of the above error to be performed (Step S14). When the operation judged to be inexecutable because of the above error by the judging device 524 is about to be performed (NO in Step S15), the display controller 523 causes the display device 410 to display the screen showing the error removing procedure (Step S16). According to this control, the display controller 523 immediately causes the display device 410 to display an instruction receiving screen if there is any partial operation executable regardless of an occurrence of an error. Therefore, operational convenience can be further improved.

For example, if a switch instruction to the copier function is inputted to the corresponding function changeover key 431 by the operator while the display controller 523 causes the display device 410 to display an error removing procedure because a sheet jam error occurred during the printing of data received from a network-connected personal computer, the display controller 523 causes the display device 410 to display an instruction receiving screen for the copier function since a document reading operation is executed even if the sheet jam has not been removed. Then, the display controller 523 causes the display device 410 to display the error removing procedure when the read data is to be printed on a recording sheet upon finishing the document reading operation.

Figure 9:
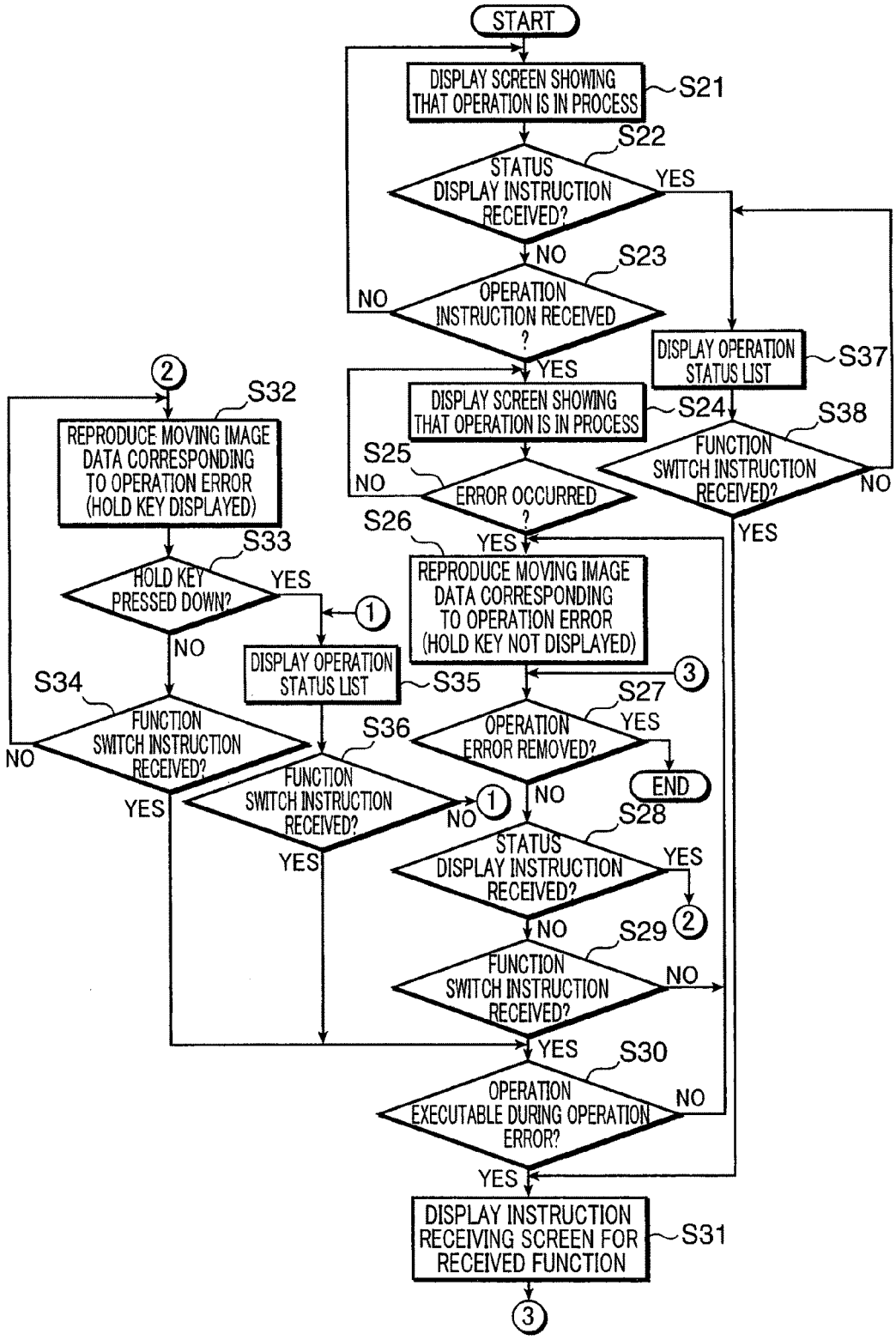
FIG. 9 is a flow chart showing a third embodiment of the screen display control executed when an operation error occurs and an operation instruction is received in the composite apparatus.
Figure 10:
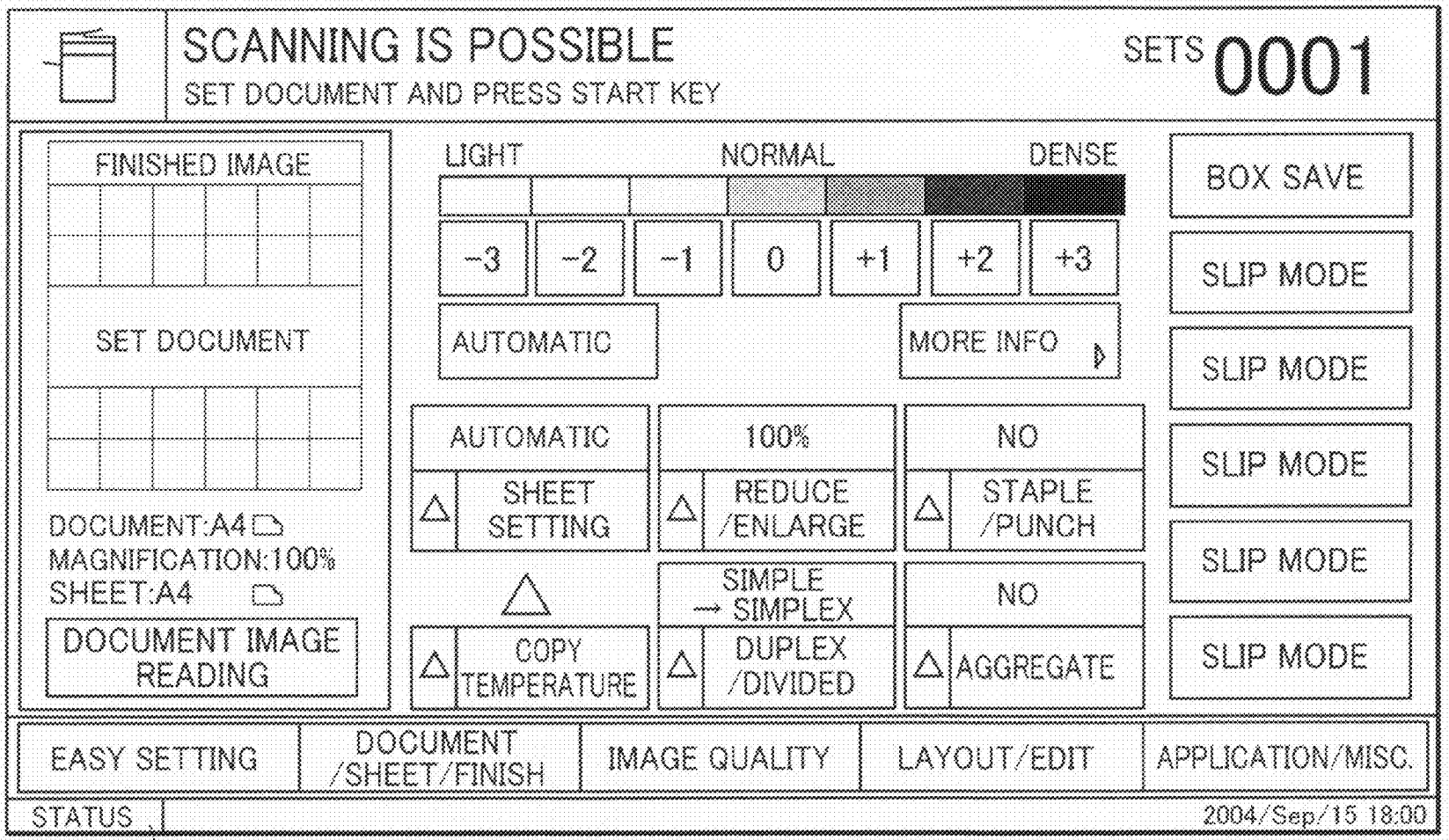
FIG. 10 is a diagram showing an example of a reception screen for an operation instruction concerning a copier function.
Figure 11:
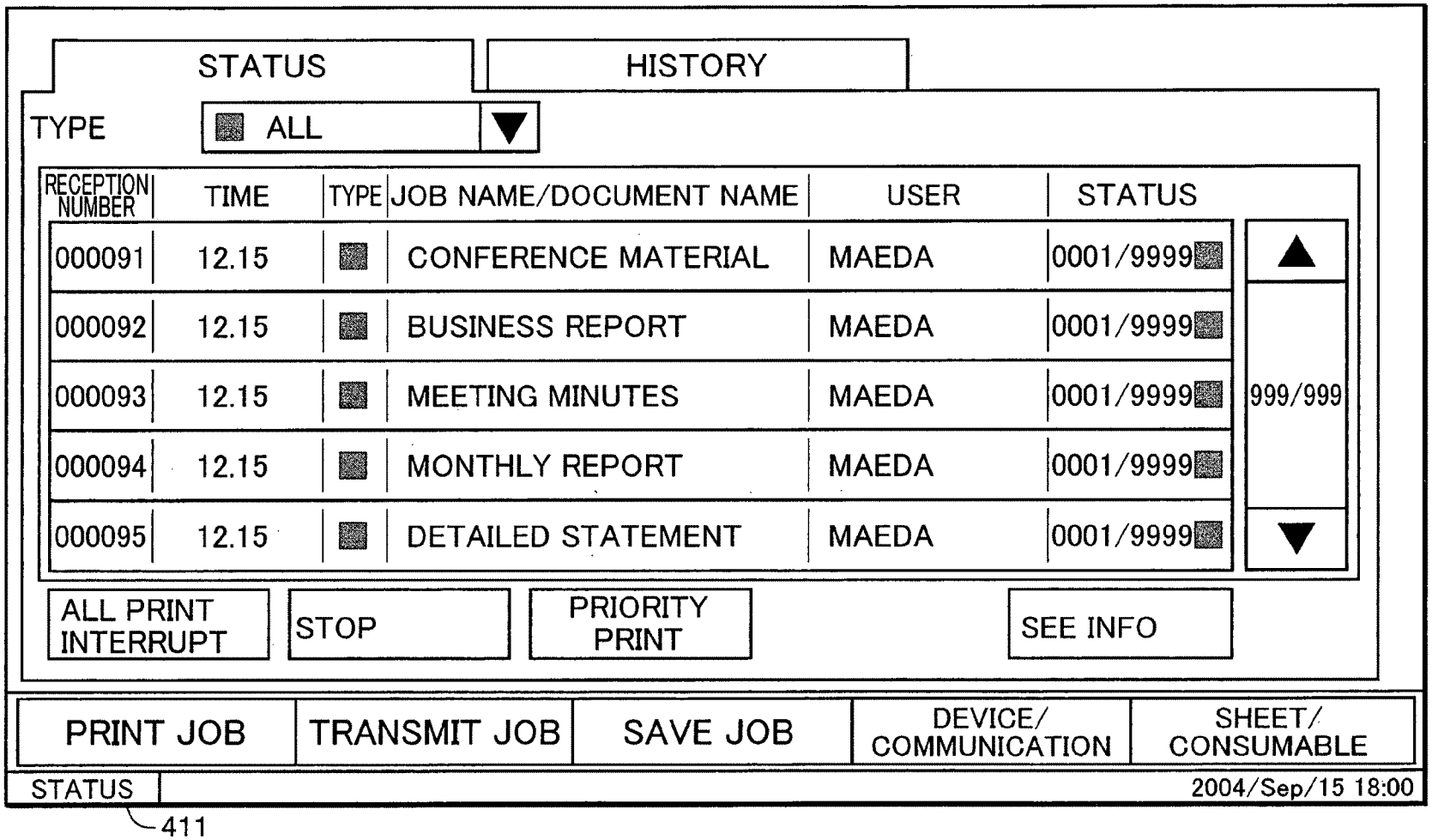
FIG. 11 is a diagram showing an example of a screen displaying an operation status list.
Figure 12:
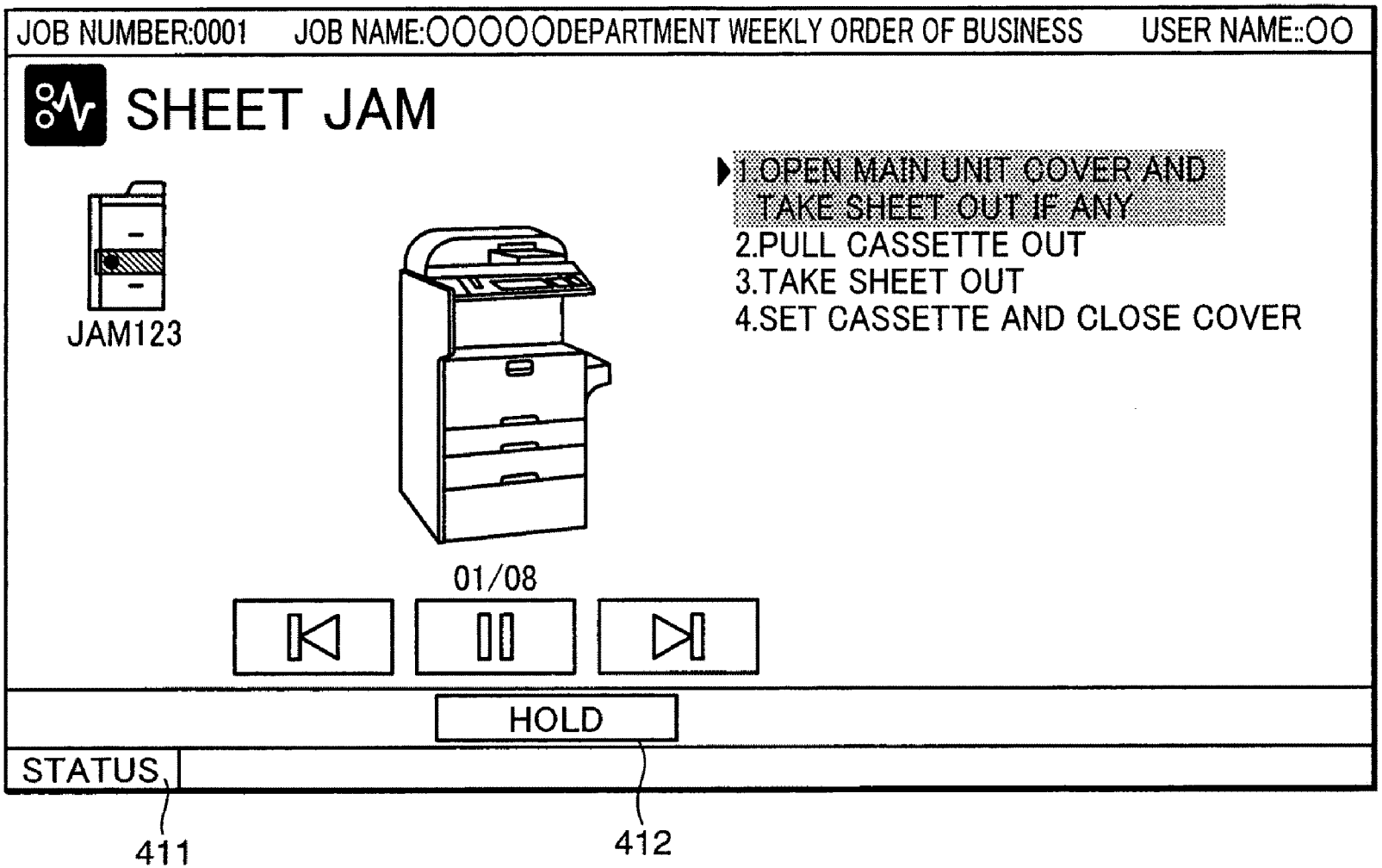
FIG. 12 is a diagram showing an example of a display screen with a hold key displaying that an operation error of a sheet jam occurs.

Next, a third embodiment of the screen display control executed when an operation error occurs and an operation instruction is received in the composite apparatus 1 is described. FIG. 9 is a flow chart showing the third embodiment of the screen display control executed when an operation error occurs and an operation instruction is received in the composite apparatus 1; FIG. 10 is a diagram showing an example of an operation instruction receiving screen for the copier function; FIG. 11 is a diagram showing an example of a display screen displaying an operation status list; and FIG. 12 is a diagram showing an example of a display screen with a hold key made in the event of an operation error caused by a sheet jam. The third embodiment is described with reference to FIGS. 4 to 6 above as well as FIGS. 9 to 12.

If an instruction to display operation statuses is received by a status display key 411 from an operator (YES in Step S22) while an instruction receiving screen for receiving an instruction on any one of the copier function, the facsimile function, the printer function, the scanner function and the like, for example, an instruction receiving screen for the copier function as shown in FIG. 10 is displayed on the display device 410 in the composite apparatus 1 (Step S21), the display controller 523 causes the display device 410 to display an operation status list as shown in FIG. 11 (Step S37).

If a function switch instruction from the operator is received by the corresponding function changeover key 431 (YES in Step S38) while the above operation status list is displayed on the display device 410, the display controller 523 causes the display device 410 to display an instruction receiving screen for receiving an instruction on the function based on this function switch instruction (Step S31).

If an instruction to execute an operation indicated by the function being displayed is received at the operation unit 400 from the operator (NO in Step S22, YES in Step S23) while the display controller 523 is causing the display device 410 to display the instruction receiving screen for the function in Step S21, the operation controller 521 causes the respective sections of the apparatus to perform operations based on this instruction and the display controller 523 causes the display device 410 to display an operation screen displaying the corresponding operation (Step S24). For example, if the instruction receiving screen for the copier function is displayed in Step S21 and a copying instruction is received at the operation unit 400 from the operator, the display controller 523 causes the display device 410 to display a display screen showing that copying is in process as shown in FIG. 4. Hereinafter, description is given, taking the case of the copying operation as an example.

If the error detector 522 detects an operation error caused, for example, by a sheet jam during the above copying operation (YES in Step S25), the display controller 523 reads moving image data for screen displays in the event of the operation error caused by the sheet jam from the display image data storage 53, reproduces the moving image data and causes them to be displayed on the display device 410 (Step S26). The display controller 523 causes the display device 410 to display, for example, an operation error display screen as shown in FIG. 5 by this moving image data reproduction and also to display an operation procedure necessary for the operator to remove the operation error caused by the sheet jam. The display controller 523 causes the status display key 411 to be displayed on this operation error display screen, but not a hold key 412. When the error detector 522 detects the removal of the operation error, the display controller 523 causes the display device 410 to stop displaying the operation error display screen (YES in Step S27).

If no instruction to display the operation status list is received by the status display key 411 from the operator (NO in Step S27, NO in Step S28) while the display controller 523 is causing the display device 410 to display the operation error display screen (Step S26) and a function switch instruction is received by the function changeover key 431 from the operator (YES in Step S29), the judging device 524 judges whether or not the operation based on the function after the switch in response to this instruction is executable even if the presently occurring operation error (operation error detected by the error detector 522 in Step S25) continues without being removed (Step S30).

If the judging device 524 judges that the function indicated by the function switch instruction received by the function changeover key 431 is executable even if this operation error is not removed (YES in Step S30), the display controller 523 reads image data necessary to display an instruction receiving screen for the function indicated by the function switch instruction from the display image data storage 53, and causes the display device 410 to display the read image data (Step S31).

For example, even if a sheet jam occurs in the sheet conveyance path from the sheet cassettes 201 during the copying operation, the copying operation is stopped, and the display of an occurrence of the sheet jam is made on the display device 410, a scanning operation can be executed since a read document is conveyed by the document conveying portion 603 of the document feeding unit 600 and the sheet conveyance path extending from the sheet cassettes 201 needs not be used even after the reading operation. Thus, if the function changeover key 431 receives an instruction to switch to the scanner function from the operator, the display controller 523 reads necessary image data from the display image data storage 53 and causes the display devices 410 to display the instruction receiving screen for the scanner function as shown in FIG. 6.

If the judging device 524 judges that the function indicated by the function switch instruction inputted to the function changeover key 431 from the operator is inexecutable unless the presently occurring operation error is removed while the operation error display screen showing the operation error removing procedure is displayed on the display device 410 (NO in Step S30), this routine returns to Step S26 and the display controller 523 continues to cause the display device 410 to display the operation error display screen to show the operation procedure necessary to remove the above operation error. For example, if the function is switched to the box function when a sheet jam occurs in the sheet conveyance path extending from the sheet cassettes 201 during a copying operation, the copying operation is stopped and the display of an occurrence of the sheet jam is made on the display device 410, and an instruction to print a selected data is given using this box function, this operation is judged to be inexecutable by the judging device 524 unless the sheet jam error is removed since the sheet conveyance path extending from the sheet cassettes 201 is used for this operation, and the display controller 523 continues to cause the display device 410 to display the operation procedure necessary to remove the sheet jam.

On the other hand, if the instruction to display the operation status list is received by the status display key 411 from the operator (NO in Step S27, YES in Step S28) while the display controller 523 is causing the display device 410 to display the operation error display screen in Step S26, the display controller 523 causes the display device 410 to display the operation error display screen with the hold key 412 (Step S32). An example of the operation error display screen with this hold key 412 is shown in FIG. 12. If an instruction to switch the operation error display screen, i.e. an instruction to switch the operation error display screen to an operation status list display screen is received by the hold key (switch receiving key) 412 from the operator during the display of this operation error display screen (YES in Step S33), the display controller 523 causes the display device 410 to display the operation status list (Step S35). If a function switch instruction from the operator is received by the function changeover key 431 (YES in Step S36) while the display controller 523 is causing the display device 410 to display the operation status list, this routine returns to Step S30.

If the instruction to switch the operation error display screen is not received from the operator during the display of the operation error display screen in Step S32 (NO in Step S33) and the function switch instruction is received by the function changeover key 431 (YES in Step S34), this routine returns to Step S30 without the display controller 523 causing the display device 410 to display the operation status list.

This routine returns to Step S27 after the display controller 523 causes the display device 410 to display the instruction receiving screen for the function indicated by the function switch instruction in Step S31, whereupon the display controller 523 repeats the processes of Steps S28 to S36 unless the error detector 522 detects the removal of the operation error.

According to the screen display control as above, even if the status display instruction is received from the operator, the occurrence of the operation error is displayed on the display device 410 if the operation error is occurring. Thus, the operator can sufficiently recognize the occurrence of the operation error. Further, since the hold key 412 is displayed on this operation error display screen of the display device 410 and the operation statuses are displayed if the switch instruction to the operation status display is received by this hold key 412 from the operator, the operator can not only sufficiently recognize the occurrence of the operation error, but also confirm the operation statuses.

It should be appreciated that the present invention is not limited to the constructions of the above embodiments and various modifications can be made. For example, the screen display switching control in the case where the display controller 523 causes the display device 410 to display the operation procedure of removing the operation error caused by the sheet jam is described as an example in the foregoing respective embodiments. However, the present invention is, of course, also applicable to a screen display switching control in the case where the display controller 523 causes the display device 410 to display an operation procedure of removing an abnormal stop caused by the breakdown of the image forming assembly 33, the transferring assembly 34 or the like. Further, the operation procedure is not limited to the one for the removal of an operation error and the present invention is also applicable to the case where the display controller 523 causes the display device 410 to display an operation procedure of guiding another operation (e.g. how to replenish the sheet cassette with sheets).

Although the construction and the operations shown in FIGS. 1 to 12 are those of the composite apparatus 1 in the foregoing embodiments, they are merely examples and do not limit the construction and operations of the image forming apparatus according to the present invention.

Further, although the image forming apparatus according to the present invention is described as the composite apparatus 1 in the foregoing embodiment, it is not limited to the composite apparatus.

To sum up, the present invention is directed to an image forming apparatus capable of executing a plurality of functions, comprising operating portion to which an operation instruction is inputted by an operator; display portion for displaying an operation guide to the operator; error detecting portion for detecting an occurrence of an operation error; and display controller for causing a screen displayed on the display portion to differ depending on whether or not the error detecting portion is detecting any operation error if an operation instruction is inputted to the operation portion by the operator.

With this construction, since the screen displayed on the display portion is caused to differ by the display controller depending on whether or not the error detecting portion is detecting any operation error if the operation instruction is inputted to the operation portion by the operator. Thus, the operator can recognize anew whether or not an error is occurring in any one of operations in the image forming apparatus by seeing which screen is displayed. Therefore, the operator can sufficiently recognize the occurrence of the operation error in the image forming apparatus.

In the present invention, it is preferable that the operating portion includes function switch instruction input portion to which a function switch instruction to switch a function to be executed is inputted by the operator; that judging portion is further provided to judge whether or not a function indicated by the function switch instruction inputted to the function switch instruction input portion is executable even if the operation error detected by the error detecting portion continues; and that the display controller causes the display portion to display an occurrence of an operation error if the error detecting portion is detecting any operation error and causes the display portion to display an instruction receiving screen for receiving an instruction for a corresponding function if a function switch instruction is inputted to the function switch instruction input portion during the display of the occurrence of the operation error and the judging portion judges that an operation based on the function indicated by the function switch instruction is executable even during the occurrence of the operation error.

According to this invention, the display controller causes the display portion to display the instruction receiving screen for the corresponding function if the judging portion judges that the operation indicated by the function switch instruction inputted to the function switch instruction input portion is executable even during the occurrence of the operation error even while the display controller is causing the display portion to display the occurrence of the operation error. Thus, if the operator inputs the function switch instruction to the function switch instruction input portion, the instruction receiving screen for the function corresponding to the inputted function switch instruction is displayed on the display portion in the case where the function corresponding to the inputted function switch instruction is executable even during the occurrence of the operation error. Therefore, according to the present invention, it is possible not only to perform the executable function-based operation during the occurrence of the operation error, but also to enable the operator to recognize whether or not the operation based on the function corresponding to each inputted function switch instruction is executable during the occurrence of the error by looking at the display screen of the display portion. Further, the operator can input an instruction for a next function immediately after the display screen of the display portion is switched to an instruction receiving screen for the next function.

In the present invention, the display controller preferably continues to cause the display portion to display the occurrence of the operation error if a function switch instruction is inputted to the function switch instruction input portion during the display of the operation error on the display portion and the judging portion judges that an operation based on a function indicated by the function switch instruction is inexecutable during the occurrence of the operation error.

According to this invention, even if the display controller causes the display portion to display the occurrence of the operation error, the display controller continues to cause the display portion to display the occurrence of the operation error if the function corresponding to the function switch instruction inputted by the operator is inexecutable. Thus, if the operator inputs the function switch instruction to the function switch instruction input portion, the occurrence of the operation error is displayed on the display portion in the case where the function corresponding to the inputted function switch instruction is inexecutable during the occurrence of the operation error. Therefore, the operator can recognize whether or not an operation based on the function corresponding to each inputted function switch instruction is executable during the occurrence of the operation error by looking at the display screen of the display portion.

In the present invention, the display controller preferably causes the display portion to display an instruction receiving screen for receiving an instruction for a corresponding function if a function switch instruction is inputted to the function switch instruction input portion during the display of the operation error on the display portion and the judging portion judges that an operation based on a function indicated by the function switch instruction is partly executable even during the occurrence of the operation error.

According to this invention, the display controller immediately causes the display portion to display the instruction receiving screen if the operation based on the function indicated by the function switch instruction inputted by the operator is partly executable even during the occurrence of the operation error. Thus, operational convenience at the time of the input of an instruction for another operation executable even during the occurrence of the operation error can be further improved.

In the present invention, it is preferable that the operating portion includes status display instruction receiving portion for receiving a status display instruction to cause the display portion to display operation statuses of the plurality of functions from the operator; and that the display controller causes the display portion to display the occurrence of an operation error if the error detecting portion is detecting any operation error and causes the display portion to display the operation statuses of the plurality of functions if the error detecting portion is detecting no operation error when the status display instruction receiving portion receives the status display instruction from the operator.

According to this invention, the display controller causes the display portion to display the occurrence of the operation error if the error detecting portion is detecting any operation error even though the status display instruction receiving portion receives the status display instruction from the operator. Thus, the operator can sufficiently recognize the occurrence of the operation error.

In the present invention, it is preferable that the display portion has a touch panel function capable of receiving an instruction from the operator; and the display controller causes the display portion to display the occurrence of the operation error and a switch receiving key for receiving a switch instruction to switch to the display of the operation statuses from the display of the occurrence of the operation error from the operator by the touch panel function if the status display instruction receiving portion receives the status display instruction and the error detecting portion is detecting any operation error, and causes the display portion to display the operation statuses if the switch receiving key receives the switch instruction.

According to this invention, even though the status display instruction receiving portion receives the status display instruction from the operator, the display controller causes the display portion to display the occurrence of the operation error if the error detecting portion is detecting any operation error. At this time, if the switch receiving key displayed together with the occurrence of the operation error receives the switch instruction to switch to the display of the operation statuses, the display controller causes the display portion to display the operation statuses. Therefore, the operator can sufficiently recognize the occurrence of the operation error and can also recognize the operation statuses of the image forming apparatus.

In the present invention, the display controller causes the display portion to display the occurrence of the operation error without the switch receiving key if the error detecting portion has detected any operation error during the operation of the apparatus.

According to this invention, the occurrence of the operation error is displayed without the switch receiving key if the error detecting portion has detecting any operation error during the operation of the apparatus and the display controller causes the display portion to display the occurrence of the operation error based on the detected operation error. Thus, the operator cannot easily switch the operation error display by portion of the switch receiving key. In this way, the operator can recognize the importance of removing the operation error in the event of the operation error during the operation of the apparatus.

In the present invention, it is preferable that the operating portion includes function switch instruction input portion to which a function switch instruction to switch a function to be executed is inputted by the operator; that judging portion is further provided to judge whether or not a function indicated by the function switch instruction inputted to the function switch instruction input portion is executable even if the operation error detected by the error detecting portion continues; and that the display controller causes the display portion to display the occurrence of the operation error without the switch receiving key if the function switch instruction is inputted to the function switch instruction input portion during the display of the operation error on the display portion and the judging portion judges that the operation based on the function indicated by the function switch instruction is inexecutable during the occurrence of the operation error.

According to this invention, the occurrence of the operation error is displayed without the switch receiving key if the judging portion judges that the operation based on the function indicated by the function switch instruction inputted during the display of the occurrence of the operation error is inexecutable during the occurrence of the operation error and the display controller causes the display portion to display the occurrence of the operation error based on this judgment. Thus, the operator cannot easily switch the operation error display by portion of the switch receiving key. Therefore, the operator can recognize the importance of removing this operation error.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

This application is based on Japanese Patent application serial Nos. 2006-052403 and 2006-052666, filed in Japan Patent Office on Feb. 28, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus capable of executing a plurality of functions, comprising:

an operating portion to which an operation instruction is inputted by an operator;

a display portion for displaying an operation guide to the operator;

an error detecting portion for detecting an occurrence of an operation error; and a display controller for causing a screen displayed on the display portion to differ depending on whether or not the error detecting portion is detecting any operation error if an operation instruction is inputted to the operation portion by the operator, wherein:

the operating portion includes function switch instruction input portion to which a function switch instruction to switch a function to be executed is inputted by the operator;

the apparatus further comprises judging portion for judging whether or not a function indicated by the function switch instruction inputted to the function switch instruction input portion is executable even if the operation error detected by the error detecting portion continues; and the display controller causes the display portion to display an occurrence of an operation error if the error detecting portion is detecting any operation error; and the display controller causes the display portion to display an instruction receiving screen for receiving an instruction for a corresponding function when a function switch instruction is inputted to the function switch instruction input portion during the display of the occurrence of the operation error, and the judging portion judges whether or not an operation based on the function indicated by the function switch instruction is executable even during the occurrence of the operation error, and the judging portion judges that the operation based on the function indicated by the function switch instruction is executable even during the occurrence of the operation error.

2. An image forming apparatus according to claim 1, wherein the display controller continues to cause the display portion to display the occurrence of the operation error when a function switch instruction is inputted to the function switch instruction input portion during the display of the operation error on the display portion, and the judging portion judges whether or not the operation based on the function indicated by the function switch instruction is executable even during the occurrence of the operation error, and the judging portion judges that the operation based on a function indicated by the function switch instruction is inexecutable during the occurrence of the operation error.

3. An image forming apparatus according to claim 1, wherein the display controller causes the display portion to display an instruction receiving screen for receiving an instruction for a corresponding function when a function switch instruction is inputted to the function switch instruction input portion during the display of the operation error on the display portion, and the judging portion judges whether or not the operation based on the function indicated by the function switching instruction is executable even during the occurrence of the operation error, and the judging portion judges that the operation based on a function indicated by the function switch instruction is partly executable even during the occurrence of the operation error.

4. An image forming apparatus according to claim 2, wherein the display controller causes the display portion to display an instruction receiving screen for receiving an instruction for a corresponding function when a function switch instruction is inputted to the function switch instruction input portion during the display of the operation error on the display portion, and the judging portion judges whether or not the operation based on the function indicated by the function switching instruction is executable even during the occurrence of the operation error, and the judging portion judges that the operation based on the function indicated by the function switch instruction is partly executable even during the occurrence of the operation error.

5. An image forming apparatus capable of executing a plurality of functions, comprising:

operating portion to which an operation instruction is inputted by an operator;

display portion for displaying an operation guide to the operator;

error detecting portion for detecting an occurrence of an operation error; and display controller for causing a screen displayed on the display portion to differ depending on whether or not the error detecting portion is detecting any operation error if an operation instruction is inputted to the operation portion by the operator, wherein:

the operating portion includes status display instruction receiving portion for receiving a status display instruction to cause the display portion to display operation statuses of the plurality of functions from the operator; and the display controller causes the display portion to display the occurrence of an operation error and a switch receiving key for receiving a switch instruction to switch to the display of the operation statuses from the display of the occurrence of the operation error from the operator by the touch panel function if the status display instruction receiving portion receives the status display instruction from the operator and the error detecting portion is detecting any operation error, and the display controller causes the display portion to switch to the display of the operation statuses of the plurality of functions from the display of the occurrence of the operation error if the switch receiving key receives the switch instruction when the status display instruction receiving portion receives the status display instruction from the operator, and the display controller causes the display portion to display the operation statuses of the plurality of functions if the error detecting portion is detecting no operation error.

6. An image forming apparatus according to claim 5, wherein the display controller causes the display portion to display the occurrence of the operation error without the switch receiving key if the error detecting portion has detected any operation error during the operation of the apparatus.

7. An image forming apparatus according to claim 5, wherein:

the operating portion includes function switch instruction input portion to which a function switch instruction to switch a function to be executed is inputted by the operator;

the apparatus further comprises judging portion for judging whether or not a function indicated by the function switch instruction inputted to the function switch instruction input portion is executable even if the operation error detected by the error detecting portion continues; and the display controller causes the display portion to display the occurrence of the operation error without the switch receiving key if the function switch instruction is inputted to the function switch instruction input portion during the display of the operation error on the display portion, and the judging portion judges whether or not the operation based on the function indicated by the function switching instruction is executable even during the occurrence of the operation error, and the judging portion judges that the operation based on the function indicated by the function switch instruction is inexecutable during the occurrence of the operation error.

* * * * *